US006757999B2

(12) United States Patent
Jurgens et al.

(10) Patent No.: US 6,757,999 B2
(45) Date of Patent: Jul. 6, 2004

(54) RETAIL STOCK LOCATOR SYSTEM

(75) Inventors: Julie Cathryn Jurgens, Bloomington, IL (US); Rose Marie Hankish, Pittsburgh, PA (US)

(73) Assignee: Eaton Corporation, Cleveland, OH (US)

( * ) Notice: Subject to any disclaimer, the term of this patent is extended or adjusted under 35 U.S.C. 154(b) by 191 days.

(21) Appl. No.: 10/184,293

(22) Filed: Jun. 27, 2002

(65) Prior Publication Data

US 2004/0000078 A1 Jan. 1, 2004

(51) Int. Cl.[7] ..... G09F 3/10
(52) U.S. Cl. ..... 40/299.01; 211/13.1
(58) Field of Search ..... 40/299.01, 638, 40/661.03; 211/13.1

(56) References Cited

U.S. PATENT DOCUMENTS

| | | | | | |
|---|---|---|---|---|---|
| 2,082,214 | A | * | 6/1937 | Osten | 40/404 |
| 3,910,412 | A | * | 10/1975 | Vargo | 206/459.5 |
| 5,297,685 | A | * | 3/1994 | Ramey | 40/638 |
| 5,445,272 | A | * | 8/1995 | Crisp | 211/13.1 |
| 6,227,386 | B1 | | 5/2001 | Close | |
| 6,304,183 | B1 | | 10/2001 | Causey | |
| 6,314,406 | B1 | | 11/2001 | O'Hagan et al. | |

* cited by examiner

*Primary Examiner*—Gary Hoge
(74) *Attorney, Agent, or Firm*—Martin J. Moran

(57) ABSTRACT

A stock locator system utilizes a first indicia to designate a bay within a retail environment, a second indicia to designate a shelf within that bay, and a third indicia to designate a location within that shelf. A user may thereby determine the location of a desired item by finding that item on a chart, determining the bay, shelf, and location within the shelf where that item is located, and proceeding to that location.

16 Claims, 4 Drawing Sheets

RETAIL STOCK LOCATOR SYSTEM

BACKGROUND OF THE INVENTION

1. Field of the Invention

The present invention is related to stock locator systems for retail environments.

2. Description of the Related Art

Various stock locator systems are presently used by retail establishments to assist employees in locating various items on the shelves. Presently used systems typically include an upper display area on each set of shelves, having samples of the product stored on the shelves, possibly along with a locator chart displaying a catalog number, product description, retailer's SKU number and/or stock locator number. The lower portion of the shelves are typically used to store the stocked product, with the stock locator numbers beginning at one end of one shelf, continuing to the opposite end of that shelf, and then wrapping around towards the beginning of the next shelf. Such a system does not make the specific shelf, or location within the shelf, on which a product is located readily apparent.

Some automated warehouses use a plurality of bays, with each bay containing a robotic arm slidably mounted to a moving column. To store or retrieve items, the column is moved to the appropriate location, and the arm is moved to the appropriate height, so that the arm is in the location of the desired item.

Accordingly, there is a need for an improved stock locator system, wherein a user may look up the desired product on a chart, and thereby be directed to an appropriate bay, shelf, and location on that shelf.

SUMMARY OF THE INVENTION

The present invention is a stock locator system providing a system of indicia identifying the appropriate bay, shelf, and location within a shelf of a desired item. For example, individual bays may be identified by a first indicia such as color. Individual shelves within each bay may be identified by a second indicia, such as numeric or alphabetical. Specific locations within each shelf may be denoted by a third indicia, such as numeric.

A typical bay utilizing the system of the present invention may, for example, include a display area for displaying product samples or display models, and a product locator chart. The product locator chart may contain a list of products, and the products' location by bay, shelf, and location within a shelf. The bay may also contain shelves divided into sections with each section containing the items specified in the chart.

To use the stock locator system of the present invention, the user, either a store employee or a customer, will find the desired item on the chart. The chart will indicate the bay, shelf, and location within the shelf of the desired item, for example, the bay color, shelf number, and number corresponding to the location on the shelf. The user may then proceed to the appropriate bay, find the appropriate shelf, and then find the appropriate location on that shelf, thereby locating the desired item.

It is therefore an aspect of the present invention to provide a stock locator system having a first indicia designating a bay, a second indicia designating a shelf within the bay, and a third indicia designating a location on the shelf.

It is another aspect of the present invention to provide a stock locator system whereby a user may quickly and easily determine the exact location of the desired item by simply looking at a chart.

It is a further aspect of the present invention to provide a stock locator system usable by both customers and store employees.

These and other aspects of the invention will become apparent through the following description and drawings.

BRIEF DESCRIPTION OF THE DRAWINGS

Like reference numbers denote like elements throughout the drawings.

DETAILED DESCRIPTION

Figure 1:
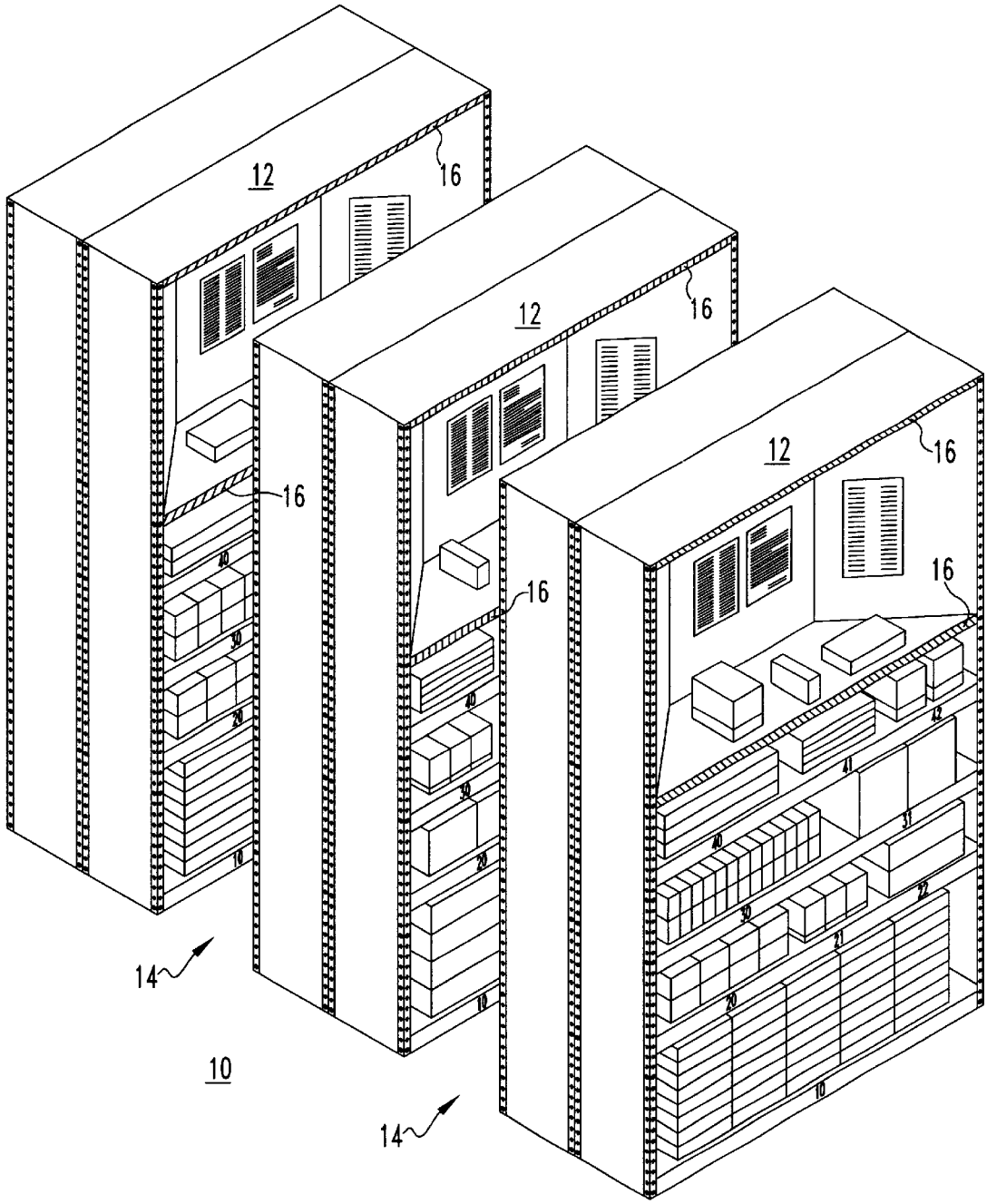
FIG. 1 is an environmental, isometric view of a stock locator system according to the present invention.
Figure 2:
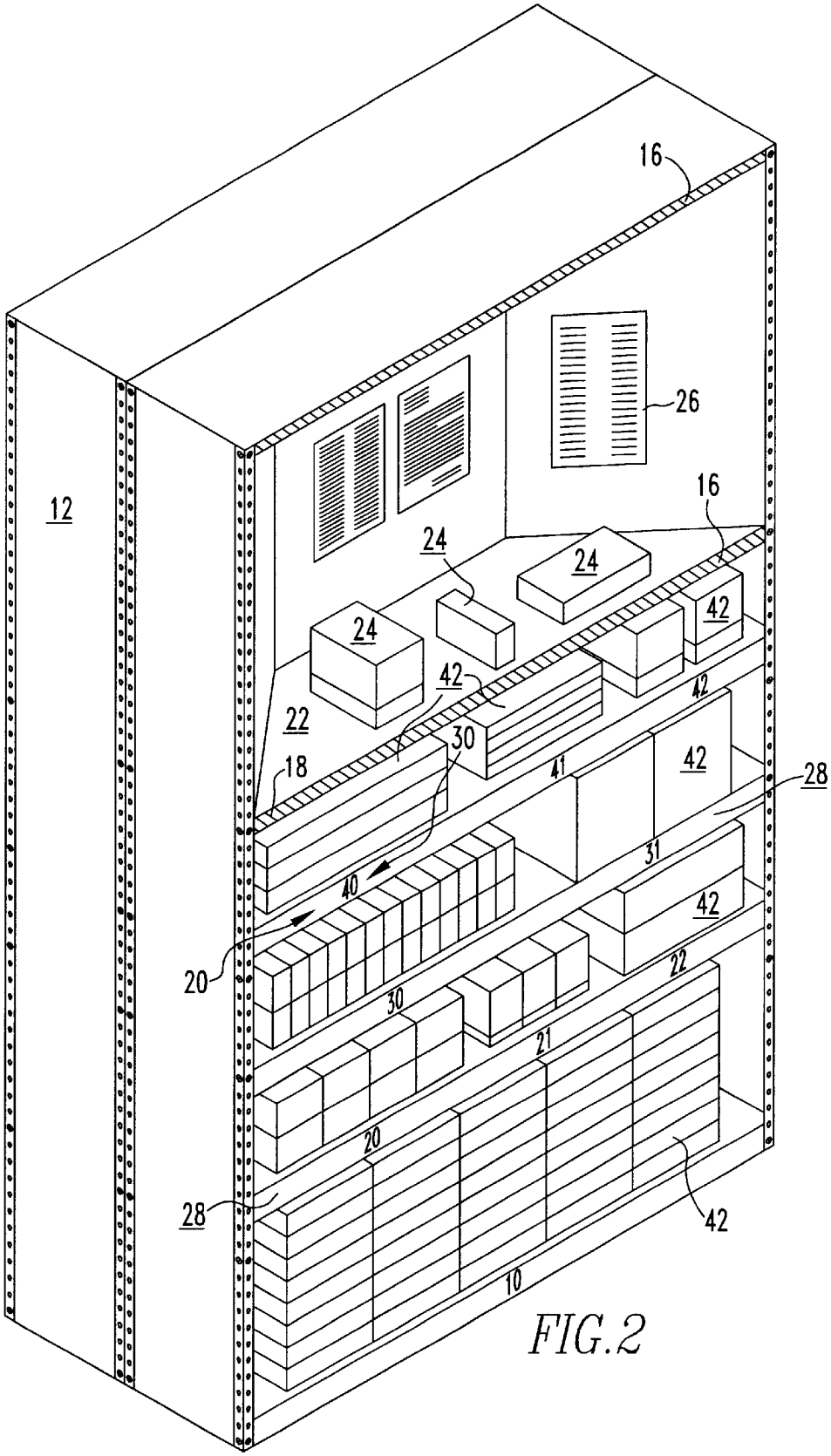
FIG. 2 is an isometric view of a shelf assembly within a stock locator system according to the present invention.

The present invention is an improved stock locator system. Referring to FIGS. 1–2, a section of a retail store 10 is illustrated. The retail store 10 includes a plurality of shelf assemblies 12, arranged to define a plurality of bays 14. Each bay 14 has at least one shelf assembly 12 on one side, and will generally have a shelf assembly 12 on either side, so that a person entering the bay 14 may access the shelves of at least one shelf assembly 12. The bays 14 are designated by a first indicia 16, which in the present example is a color. Each of the shelf assemblies 12 includes a plurality of shelves 18. The shelves 18 are each associated with a second indicia 20, which in the present example is numeric, but may alternatively be alphabetic. The shelves 18 are dimensioned and configured to display and/or store items in a manner making them accessible to the consumer. The shelf assemblies 12 may optionally include a display area 22, dimensioned and configured for displaying samples of product models 24, and possibly product locator charts 26. Each shelf 18 is further subdivided into shelf sections 28, with each shelf section 28 associated with a third indicia 30, which in the present example is numeric, but may alternatively be alphabetic. Each shelf section includes various items of merchandise 42. The product locator chart 26 may be either a physical chart or a computer terminal. The product locator charts 26 may be located within the display area 22 and/or at other locations within the retail store 10.

Figure 4:
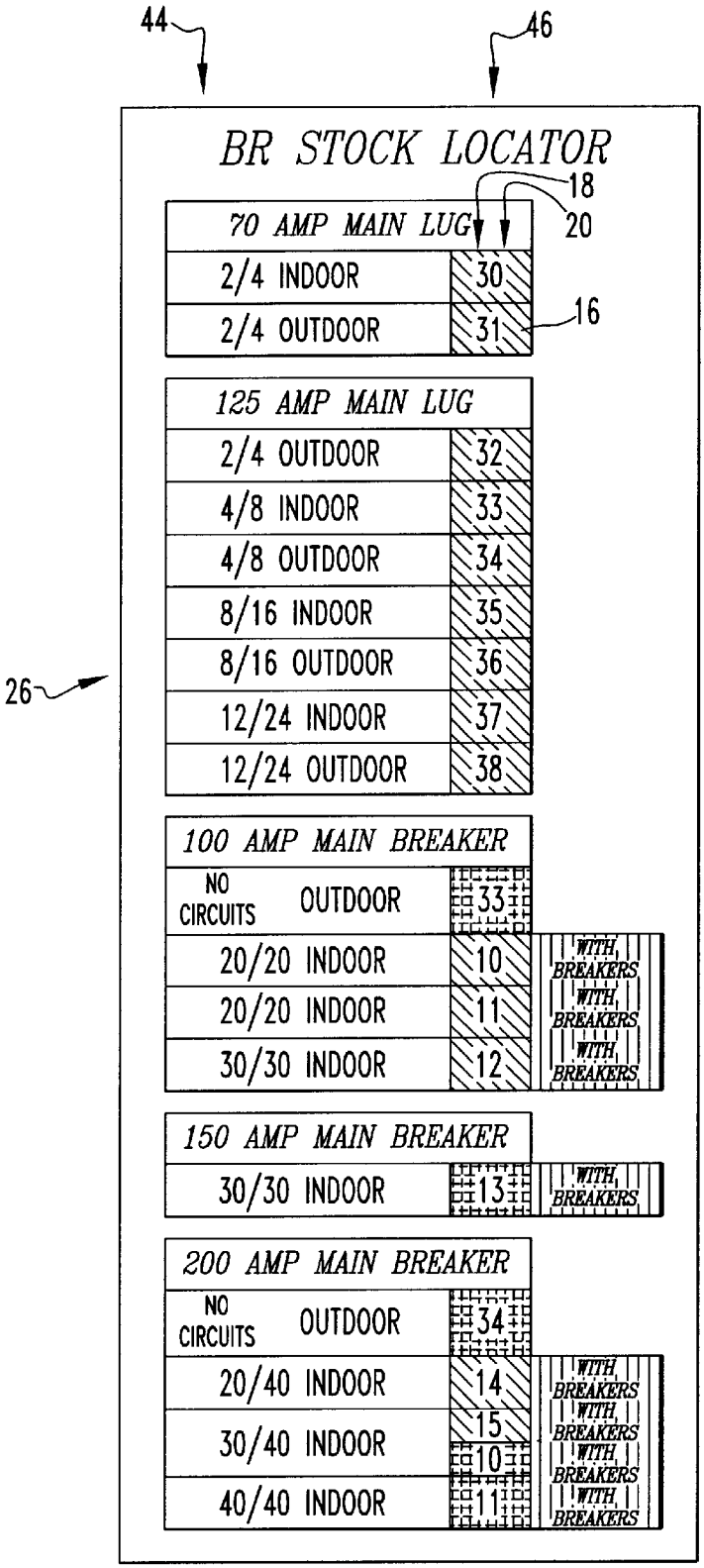
FIG. 4 is a product locator chart for use in conjunction with the present invention.

One example of a product locator chart 26 is illustrated in FIG. 4. The illustrated example stock locator chart 26 includes a first column 44, listing the various products available, and a second column 46, indicating the bay, shelf, and location on a shelf where the listed product is located. Column 46 includes color indicia 16 for indicating the appropriate bay for each product listed in 44, shelf indicia 18, and indicia for the location within the shelf 20.

When a user, whether a customer or sales person, wishes to locate an item within the store 10, the user may first find the product within the product locator chart 26. Upon finding the item in the product locator chart 26, the user will learn the specific first indicia 16, second indicia 20, and third indicia 30 (in the illustrated example color, first number, and second number) associated with the item. The user may then locate the bay 14 associated with the appropriate color 16. Upon entering the appropriate bay 14, the user will next locate the shelf 18 located with the appropriate number 20.

Lastly, the user will locate the location 28 within the shelf 18 associated with the number 30. At this point, the user has located the desired item.

Figure 3:
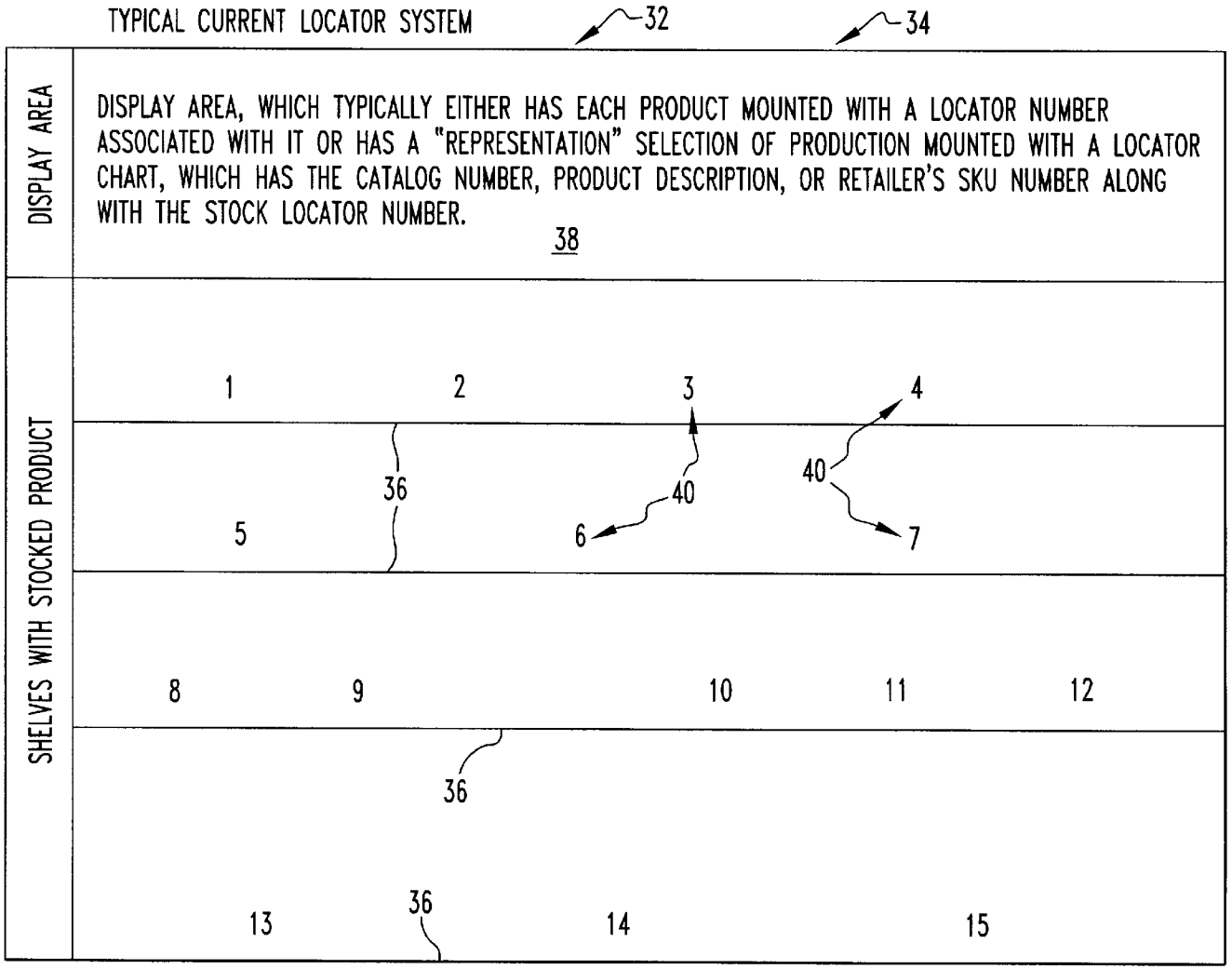
FIG. 3 (PRIOR ART)
FIG. 3 is a side plan view of a prior art stock locator system.

A stock locator system of the present invention is clearly advantageous as compared to a prior art stock locator system, illustrated in FIG. 3. The prior art stock locator system 32 includes a plurality of shelf assemblies 34, with each shelf assembly 34 having one or more shelves 36. The shelf assembly 34 may also include a display area.

Within the prior art stock locator system 32, items on the shelves 34 will typically be assigned a stock locator number 40. The stock locator numbers 40 will typically be arranged so that they begin at one end of one shelf, proceed to the other end of that shelf, and then wrap around to another shelf. As can be seen from FIG. 2, even if the stock locator number 40 is known, the location of the desired item on those shelves 34 is not readily apparent.

While a specific embodiment of the invention has been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the appended claims and any and all equivalents thereof.

What is claimed is:

1. A stock locator system for use in a retail store, said stock locator system comprising:

a plurality of shelf assemblies defining a plurality of bays therebetween;

each of said bays having a plurality of shelves within said shelf assemblies, said shelves being accessible from within said bays;

each of said shelves further defining a plurality of shelf sections;

a first indicia denoting each of said bays;

a second indicia denoting each of said shelves within each of said bays;

a third indicia denoting each of said shelf sections on each of said shelves; and a chart displaying a correlation between said first, second, and third indicia and merchandise on said shelves.

2. The stock locator system according to claim 1, wherein said first, second, and third indicia are selected from the group consisting of color, alphabetical, and numerical.

3. The stock locator system according to claim 2, wherein said first indicia is color.

4. The stock locator system according to claim 2, wherein said second indicia is numeric.

5. The stock locator system according to claim 2 wherein said third indicia is numeric.

6. A stock locator method for use in a retail store, said stock locator method comprising:

providing a plurality of shelf assemblies defining a plurality of bays therebetween;

providing a plurality of shelves within the shelf assemblies, said shelves being accessible from within said bays;

providing a plurality of shelf sections, defined within said shelves;

providing an association between each of said bays and a first indicia;

providing an association between each of said shelves within each of said bays and a second indicia;

providing an association between each of said shelf sections on each of said shelves and a third indicia; and providing a chart displaying a correlation between said first, second, and third indicia and merchandise on said shelves.

7. The stock locator method according to claim 6, further comprising:

finding a desired item on said chart; and determining the first, second, and third indicia associated with said desired item.

8. The stock locator method according to claim 7, further comprising:

locating said bay corresponding to said first indicia;

locating said shelf corresponding to said second indicia; and locating said shelf section corresponding to said third indicia.

9. The stock locator method according to claim 8, wherein said first, second, and third indicia are selected from the group consisting of color, alphabetical, and numerical.

10. The stock locator method according to claim 9, wherein said first indicia is color.

11. The stock locator method according to claim 9, wherein said second indicia is numeric.

12. The stock locator method according to claim 9, wherein said third indicia is numeric.

13. The stock locator method according to claim 6, wherein said first, second, and third indicia are selected from the group consisting of color, alphabetical, and numerical.

14. The stock locator method according to claim 13, wherein said first indicia is color.

15. The stock locator method according to claim 13, wherein said second indicia is numeric.

16. The stock locator method according to claim 13, wherein said third indicia is numeric.

* * * * *